US011638936B2

(12) United States Patent
Schaal et al.

(10) Patent No.: US 11,638,936 B2
(45) Date of Patent: May 2, 2023

(54) CLEANING DEVICE

(71) Applicant: MAFAC—E. Schwarz GmbH & Co. KG Maschinenfabrik, Alpirsbach (DE)

(72) Inventors: Stefan Schaal, Dornstetten (DE); Steffen Haas, Alpirsbach (DE)

(73) Assignees: MAFAC—E. SCHWARZ GMBH & CO., Alpirsbach (DE); KG MASCHINENFABRIK, Alpirsbach (DE)

( * ) Notice: Subject to any disclaimer, the term of this patent is extended or adjusted under 35 U.S.C. 154(b) by 0 days.

(21) Appl. No.: 17/885,725

(22) Filed: Aug. 11, 2022

(65) Prior Publication Data

US 2022/0388039 A1 Dec. 8, 2022

Related U.S. Application Data

(62) Division of application No. 16/838,756, filed on Apr. 2, 2020, now abandoned.

(30) Foreign Application Priority Data

Apr. 4, 2019 (DE) ..... 102019108913.1

(51) Int. Cl.
*B08B 3/02* (2006.01)

(52) U.S. Cl.
CPC ..... *B08B 3/024* (2013.01); *B08B 3/022* (2013.01); *B08B 2203/027* (2013.01)

(58) Field of Classification Search
None
See application file for complete search history.

(56) References Cited

FOREIGN PATENT DOCUMENTS

| | | | |
|---|---|---|---|
| DE | 4111099 | C1 | 10/1992 |
| DE | 102004046802 | B3 | 4/2006 |
| DE | 102008019456 | A1 | 11/2009 |
| DE | 10216285 | B4 | 3/2012 |
| EP | 0507294 | B1 | 8/1994 |

OTHER PUBLICATIONS

"Definition of "Course"", https://www.merriam-webster.com/dictionary/course, Jul. 31, 2021, 1-2.
"Definition of "Track"", https://www.merriam-webster.com/dictionary/track, Jul. 31, 2021, 1-2.

*Primary Examiner* — Natasha N Campbell
*Assistant Examiner* — Ryan L Coleman
(74) *Attorney, Agent, or Firm* — Murphy, Bilak & Homiller, PLLC

(57) ABSTRACT

A cleaning device includes: a treatment container; a workpiece carrier arranged in the treatment container and configured to hold at least one workpiece; at least one nozzle configured to discharge a cleaning jet directed onto the workpiece carrier and mounted such that the at least one nozzle is moveable on a circulation track about the workpiece carrier and is pivotable about a pivoting axis extending parallel to an axis of rotation of the workpiece carrier; a pivoting device configured to pivot the at least one nozzle; and a controller configured to control a circulating movement of the at least one nozzle on the circulation track and a pivoting movement of the at least one nozzle, such that a specified point on a surface of the workpiece is impacted repeatedly by the cleaning jet at a respectively different angle, within a specified timeframe.

9 Claims, 6 Drawing Sheets

CLEANING DEVICE

TECHNICAL FIELD

This description generally relates to a cleaning method and a cleaning device. In particular, the description relates to a cleaning method by means of a cleaning device which has a cleaning chamber and a nozzle tube arranged in the cleaning chamber, said nozzle tube being able to move on a circulation track about a workpiece carrier with at least one workpiece, and a corresponding cleaning device.

BACKGROUND

The nozzle tube with this type of cleaning device comprises at least one nozzle which is directed toward the workpiece carrier and, by means of said nozzle, a cleaning liquid, such as, for example, a surfactant-containing cleaning liquid based on water, can be discharged under pressure onto the at least one workpiece being held by the workpiece carrier. Such a cleaning device is known, for example, from EP 0 507 294 B1 or from DE 102 16 285 B4.

As described in DE 10 2004 046 802, the nozzle tube of such a cleaning device may be implemented such that the nozzle can be pivoted about a longitudinal axis of the nozzle tube. An angle of impact of a cleaning jet discharged onto the workpiece through the nozzle can hereby be varied, whereby particularly efficient cleaning can be achieved.

SUMMARY

The object upon which the invention is based is provision of an improved cleaning method by means of a cleaning device, having a pivotable nozzle, and provision of a corresponding cleaning device.

The method comprises the cleaning of at least one workpiece, which is being held by a workpiece carrier in a treatment container, by means of at least one nozzle which discharges a cleaning jet directed onto the workpiece. The cleaning comprises the specifying of a rotational speed of the workpiece carrier and a circulation speed of the at least one nozzle on a circulation track about the workpiece carrier, rotating of the workpiece carrier at the specified rotational speed, and moving of the at least one nozzle at the specified circulation speed about the workpiece carrier, and pivoting of the at least one nozzle about a pivoting axis extending parallel to an axis of rotation of the workpiece carrier such that a specified point on the surface of the workpiece is impacted repeatedly by the cleaning jet at a respectively different angle within a specified timeframe.

The cleaning device comprises a treatment container; a workpiece carrier arranged in the treatment container, said workpiece carrier being designed to hold at least one workpiece; at least one nozzle; and a pivoting device. The nozzle is designed to discharge a cleaning jet directed onto the workpiece carrier and is mounted such that the nozzle can move on a circulation track about the workpiece carrier and that it can pivot about a pivoting axis extending parallel to the axis of rotation of the workpiece carrier. To this end, the pivoting device is designed to pivot the at least one nozzle. In addition, the cleaning device comprises a controller which is designed to control a circulating movement of the at least one nozzle on the circulation track and a pivoting movement of the at least one nozzle such that a specified point on a surface of the workpiece can be impacted repeatedly by the cleaning jet at a respectively different angle within a specified timeframe.

Those skilled in the art will recognize additional features and advantages upon reading the following detailed description, and upon viewing the accompanying drawings.

BRIEF DESCRIPTION OF THE FIGURES

Examples are explained in the following by means of figures. The figures are intended to illustrate certain principles to the extent that only those features necessary for understanding these principles are shown. The figures are not true-to-scale. The same reference numerals refer to equivalent features in the figures.

DETAILED DESCRIPTION

In the following description, reference is made to the attached figures which form a part of the description. Of course, the features of the individual figures can be combined with one another unless indicated otherwise.

Figure 1A:
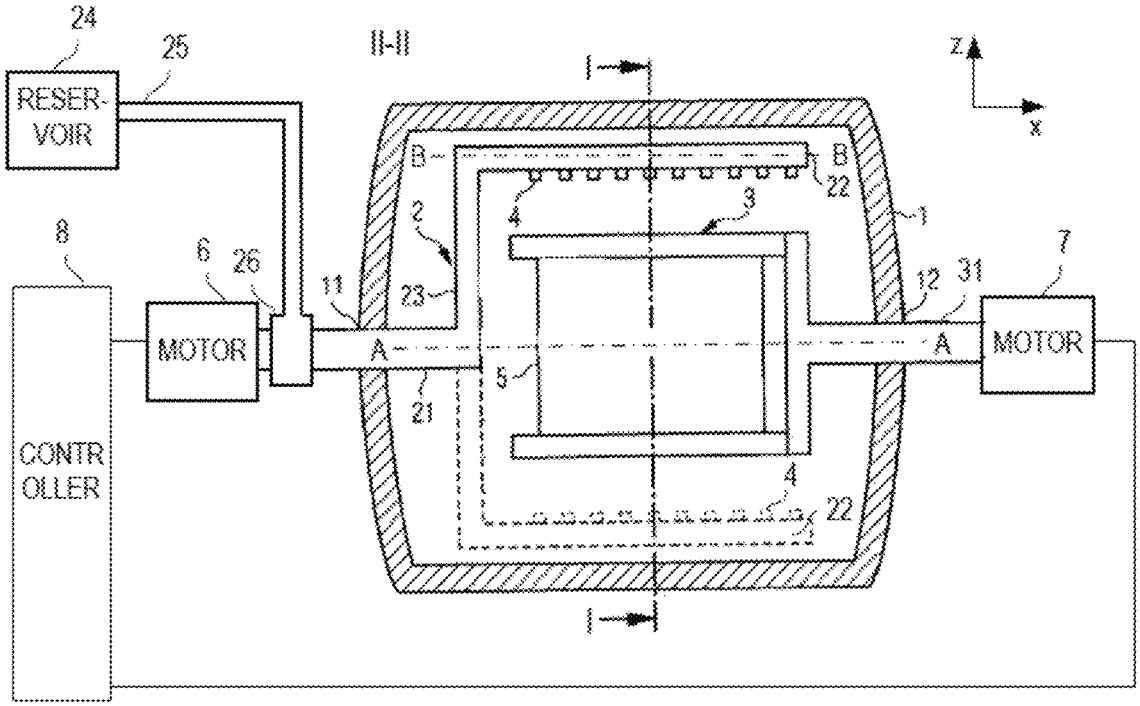
FIGS. 1A and 1B show a partial cross-section of a treatment device having a treatment container, a nozzle device, and a workpiece carrier, in two different sectional planes.
Figure 1B:
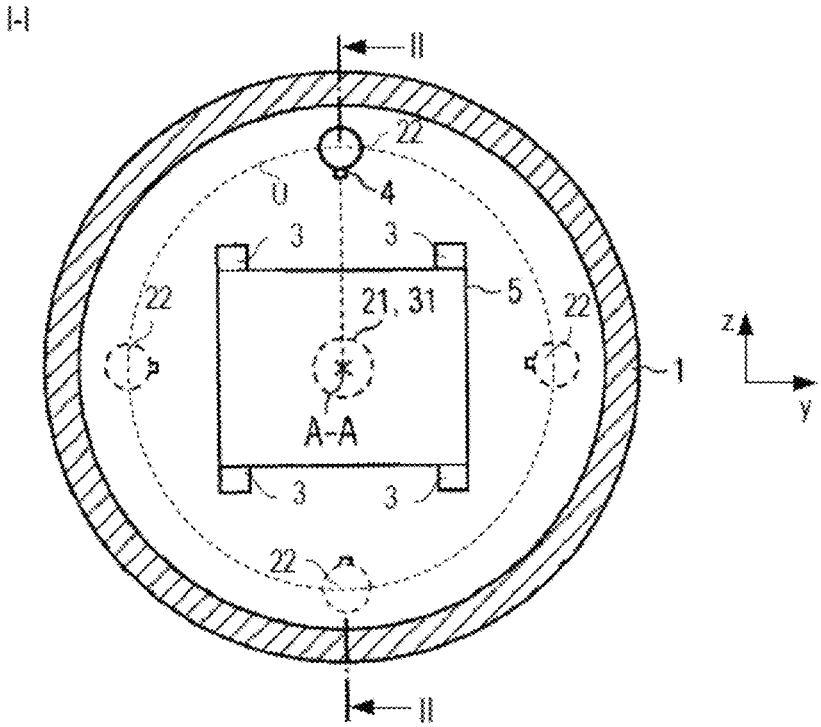

FIGS. 1A and 1B each schematically show a cleaning device for cleaning one of several workpieces, wherein FIG. 1A shows the device in a first sectional plane I-I extending parallel to an axis of rotation A-A, and FIG. 1B shows the device in a second sectional plane II-II extending perpendicularly to axis of rotation A-A. With reference to FIGS. 1A and 1B, the device comprises a treatment container 1, a nozzle device 2 arranged in the treatment container 1, said nozzle device having at least one nozzle 4 and a workpiece carrier 3 arranged in the treatment container 1, said workpiece carrier intended for holding at least one workpiece 5. Only the treatment container 1 is shown in cross-section in FIGS. 1A and 1B; the remaining parts are shown in the respective side view.

The treatment container 1 may be designed to be pressure-resistant in order to enable creation of a vacuum during a cleaning process and may have a closable or controllable discharge (not shown) for a cleaning medium in order to enable the production of a cleaning bath surrounding the at least one workpiece 5, said cleaning bath being situated in the treatment container 1.

The workpiece 5 is only shown schematically in FIGS. 1A and 1B. This workpiece 5 may be an individual workpiece which is directly held by the workpiece carrier 3. Alternatively, a plurality of workpieces (in bulk) may be in a workpiece basket which is held by the workpiece carrier 3. Such a workpiece basket secures the workpieces by keeping them from falling out and is permeable to liquid in order to enable cleaning of the workpieces. The term "workpiece" in the following thus characterizes an individual workpiece or several individual workpieces which is/are held directly by the workpiece carrier 3, or a plurality of workpieces which are held by a workpiece basket, which is held by the workpiece carrier 3.

The nozzle device 2 comprises at least one nozzle tube 22 with at least one nozzle 4 which has a nozzle outlet directed onto the workpiece carrier 3 and/or onto the workpiece 5. The nozzle device 2 is mounted such that the at least one nozzle 4 can move on a circulation track about the workpiece carrier 3. To this end, the nozzle device 2 has a first shaft 21 which is mounted rotatably such that it can rotate about an axis of rotation A-A. The nozzle 4 is arranged in a direction perpendicular to axis of rotation A-A spaced apart from axis of rotation A-A and/or the first shaft 21 and thus mounted opposite the first shaft 21 such that the nozzle 4 moves on a (circular) circulation track about rotation of axis A-A and the workpiece carrier 3 when the first shaft 21 rotates about axis of rotation A-A.

The workpiece carrier 3 may be stationary. As is shown in FIGS. 1A and 1B, the workpiece carrier 3 may also be implemented, however, such that it can rotate about axis of rotation A-A. In this case, the workpiece carrier 3 has a second shaft 31 which is mounted rotatably such that it can rotate about axis of rotation A-A.

In the example shown in FIGS. 1A and 1B, the at least one nozzle 4 is arranged on a nozzle tube 22. The nozzle tube extends substantially parallel to axis of rotation A-A and is connected to the first shaft 21 by means of a supply tube 23. The first shaft 21, the supply tube 21, and the nozzle tube 22 are hollow and form a liquid channel, by means of which cleaning liquid from a reservoir 24 (schematically shown) arranged outside of the treatment container 1 can reach the at least one nozzle 4. The reservoir 24 is connected to the shaft 21 via a line 25 and a coupling piece 26 in order to supply cleaning fluid to the shaft 21. Optionally, a pump (not shown) is arranged in the outer supply line 25, said pump being used to subject the cleaning fluid to a desired pressure. Such an arrangement with a reservoir 24, an outer supply line 25, a coupling piece 26, and a (hollow) shaft is generally known to the extent that further embodiments with respect to this are superfluous.

With the device according to FIG. 1A, the first shaft 21 of the nozzle device 2 and the second shaft 31 of the workpiece carrier 3 are guided out of the treatment container 1 on opposite sides at respective openings 11, 12. However, it is also possible to guide the first shaft 21 for the nozzle device 2 and the second shaft 31 for the workpiece carrier 3 out jointly on one side of the treatment container 1 via one of the openings 11, 12 and to omit the other one of the openings. In this case, the first shaft 21 may be designed as a hollow shaft in which the second shaft 31 is rotatably mounted, wherein a channel for the cleaning liquid may be formed along the second shaft 31, in the first shaft 21. This type of implementation of the first end of the second shaft 21, 31 is basically known and described, for example, in the previously mentioned EP 0 507 294 B1 to the extent that further embodiments regarding this are superfluous.

As previously mentioned, the nozzle device comprises at least one nozzle tube 22 with at least one nozzle 4. As is shown in FIG. 1A, several nozzles 4 may be provided on the nozzle tube 22, said nozzles being arranged apart from one another in a longitudinal direction of the nozzle tube 22. The "longitudinal direction" of the nozzle tube 22 is a direction of the nozzle tube 22 extending parallel to axis of rotation A-A. The nozzles 4 are located, for example, on an outer surface of the nozzle tube 22 and are attached at or in holes of the nozzle tube 22. Each of the nozzles 4 has a nozzle outlet, which is designed to discharge cleaning liquid in the direction of the workpiece 5, said cleaning liquid being supplied to the respective nozzle 4 via the channel formed by the first shaft 21, the supply tube 23, and the nozzle tube 22. The nozzles 4 may be implemented in any conventionally known manner According to one example, it is provided to omit the separate nozzles arranged on the nozzle tube 22 and to form the nozzles 4 through holes in the nozzle tube 22.

With reference to FIGS. 1A and 1B, the nozzle assembly may comprise several nozzle tubes 22 of the previously explained type, wherein each of these nozzle tubes 22 has at least one nozzle 4. For illustration purposes only, the example shown in FIG. 1B shows four such nozzle tubes 22 which are arranged at an angle distance of 90° relative to one another in relation to axis of rotation A-A. The provision of four nozzle tubes 22, however, is only an example. According to a further example, the nozzle assembly 2 comprises two oppositely disposed nozzle tubes 22 or even only one nozzle tube 22.

The first shaft 21 of the nozzle assembly 2 and, optionally, the second shaft 31 of the workpiece carrier 3 are driven, independently of one another, by a respective motor: a first motor 6 which drives the first shaft 21 of the nozzle assembly 2 and a second motor 7 which drives the second shaft 31 of the workpiece carrier 3. A circulation speed of the nozzle tube 22 about the workpiece carrier 3 (and the at least one workpiece 5 thereby being held) and a rotational speed of the workpiece carrier 3 and of the workpiece 5 can hereby be adjusted independently of one another, wherein the rotational speed of the workpiece carrier 3 may be zero or not equal to zero. The two motors 6, 7 are actuated by means of a controller 8, which specifies the rpm of the motors 6, 7, wherein the rpm of the first motor 6 determines the circulation speed of the nozzle tube 22 about the workpiece carrier 3 and the workpiece 5, and the rpm of the second motor 7 determines the rotational speed of the workpiece carrier 3 and of the workpiece 5.

The at least one nozzle tube 22 with the at least one nozzle 4 is pivotably mounted such that the nozzle tube 22 can pivot about a longitudinal axis B-B, which extends substantially parallel to axis of rotation A-A, within a specified pivot range. This is explained by means of FIG. 2 in the following.

Figure 2:
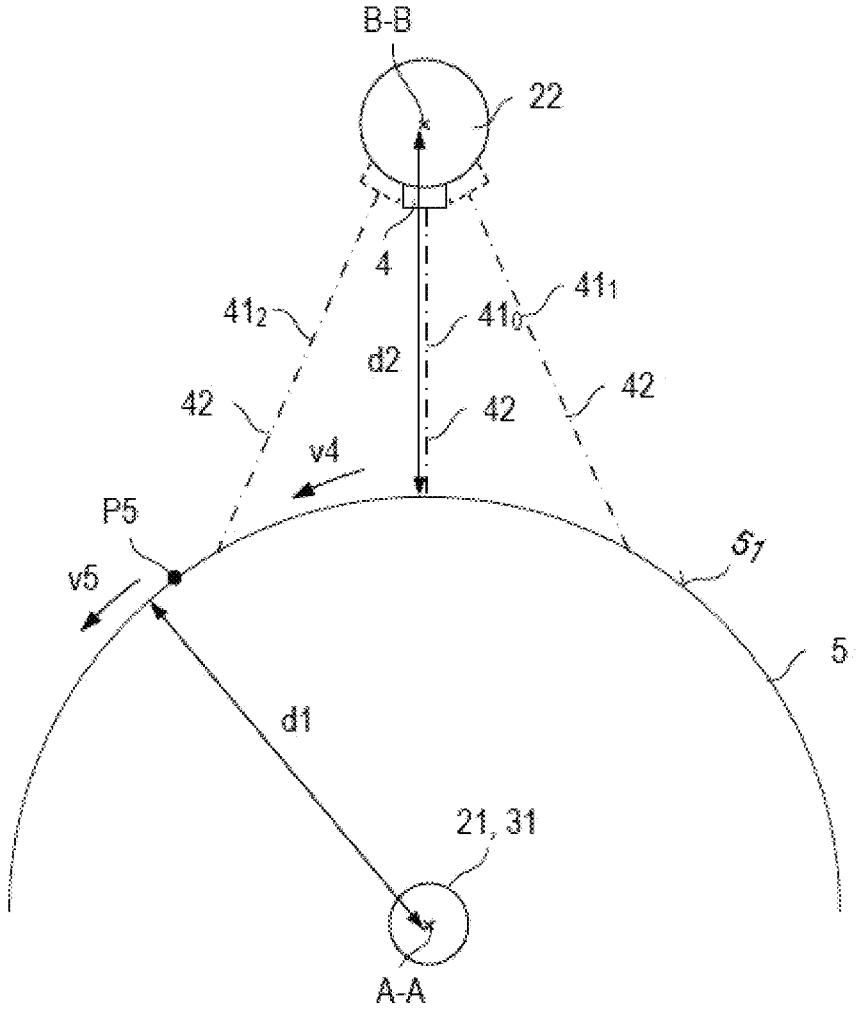
FIG. 2 illustrates the position of a liquid jet being discharged through a nozzle of the nozzle device relative to a surface of a workpiece, with different angle settings of the nozzle.

FIG. 2 schematically shows a cross-section through the nozzle tube 22 in a sectional plane extending perpendicular to longitudinal axis B-B. FIG. 2 additionally shows a cross-section through the workpiece 5, which is cylindrical in this example merely for illustration purposes. The workpiece carrier 3 is not shown in FIG. 2.

The pivot range of the nozzle tube 22 according to one example comprises a position of the nozzle tube 22 in which the outlet of the nozzle 4 points toward axis of rotation A-A. A nozzle jet 42, which is discharged through the nozzle 4 in this position of the nozzle tube 22, is represented by a dashed-and-dotted line in FIG. 2. This position of the nozzle tube 22 is also characterized as the zero position $\mathbf{41}_0$ in the following. According to one example, it is additionally provided that the nozzle tube 22 can be pivoted and/or deflected relative to the zero position $\mathbf{41}_0$ on both sides, wherein the nozzle tube specifies a respective endpoint $\mathbf{41}_1$, $\mathbf{41}_2$ in both directions. Cleaning jets which are discharged through the nozzle 4 when the nozzle tube 22 is in the first and second endpoint $\mathbf{41}_1$, $\mathbf{41}_2$ are likewise indicated by dashed-and-dotted lines in FIG. 2.

An angle range $\Delta\gamma$ between the first endpoint $\mathbf{41}_1$ and the second endpoint $\mathbf{41}_2$ is characterized in the following as a pivot range of the nozzle tube 22. This pivot range, for example, is between 10° and 80°, particularly between 30° and 70°. According to one exemplary embodiment, the first end position $41_1$ and the second end position $41_2$ are arranged symmetrical to the zero position $41_0$ to the extent that the nozzle tube 22 can pivot an equal distance in both directions, starting from the zero position $41_0$, i.e. a first angle distance γ1 between the zero position $41_0$ and the first end position $41_1$ is equal to a second angle distance γ2 between the zero position $41_0$ and the second end position $41_2$. However, this is merely an example. According to another example, the end positions $41_1$, $41_2$ are arranged asymmetrical to the zero position $41_0$ to the extent that the nozzle tube 22 can pivot an unequal distance, starting from the zero position $41_0$, in the direction of the first end setting $41_1$ and in the direction of the second end setting $41_2$.

According to one example, the nozzle tube 22 is actuated during the cleaning process to the extent that the nozzle tube 22 pivots cyclically from the first end position $41_1$ to the second end position $41_2$ and back to the first end position $41_1$ and, in doing so, passes over the respective zero position $41_0$. Such type of movement is referred to as a complete pivoting movement in the following. An impact angle, at which the cleaning jet 42 impacts a surface 51 of the workpiece 5, and also a speed of the cleaning jet relative to the workpiece surface 5 hereby repeatedly change. An especially efficient cleaning of the workpiece 5 can hereby be achieved. The change of the impact angle and the speed of the cleaning jet as compared to the workpiece surface 51 are explained in greater detail in the following. According to one example, it is additionally provided that an integer number n of complete pivoting movements are executed by the nozzle tube 22 per revolution of the nozzle tube 22 about the workpiece carrier 3. This number n, for example, is between 1 and 7, particularly between 5 and 5.

According to one example, it is provided to synchronize a circulating movement of the nozzle tube 22 about the workpiece carrier 3 and a pivoting movement of the nozzle tube 22 to one another such that a specified point on the surface 51 of the workpiece 5 is impacted repeatedly by the cleaning jet 42, at a respectively different angle, within a specified timeframe. The specified timeframe in this case, for example, is between 1 minute (min) and 10 minutes, particularly between 1 minute and 10 minutes.

With reference to FIG. 2, it should be assumed that the workpiece surface 51 moves at a speed v5 in a first direction relative to the nozzle tube 22. This means that a certain point 5 of the workpiece surface moves at speed v5 relative to the nozzle tube 22. This is achieved, for example, in that (a) the second shaft 31, which drives the workpiece 5, rotates in a first direction of rotation, and the first shaft 21, which determines the circulation speed of the nozzle tube 22 about the workpiece 5, rotates in a second direction of rotation opposite the first direction of rotation or that (b) the second shaft 31 rotates in the first direction of rotation and the first shaft 21 likewise rotates in the first direction of rotation, but at a lower rotational speed than the second shaft 31. The speed v5 at which the surface 51 of the workpiece 5 moves relative to the nozzle tube 22 would be zero (0) when both shafts 21, 31 are stopped or have the same rotational speed and the same direction of rotation.

If the cleaning jet 42 is directed statically onto the surface of the workpiece 5, i.e. without a pivoting movement of the nozzle tube 22, the speed at which the cleaning jet is guided along the surface of the workpiece 5 corresponds to the relative speed v5 of the workpiece surface 51 relative to the nozzle tube 22. When the nozzle tube 22 is executing a pivoting movement, a speed of the nozzle jet relative to the workpiece surface 51 resulting from the pivoting movement and the relative movement of the workpiece surface 51 relative to the nozzle tube 22 overlap to the extent that the speed at which the cleaning jet is guided along the workpiece surface 51 varies. Moreover, an impact angle at which the cleaning jet 42 impacts the workpiece surface 51 varies.

In order to ensure that the cleaning jet passes over a certain point of the surface 51 repeatedly within a specified time and does so at a respectively different impact angle, it may be provided to tightly couple the pivoting movement of the nozzle tube 22 with the circulating movement of the nozzle tube about the workpiece carrier to the extent that an angle position γ of the nozzle tube 22 is uniquely assigned to each position of the nozzle tube 22 on the circulation track, and to suitably establish a rotational speed ω31 of the shaft 31 of the workpiece carrier 3 and a rotational speed ω21, which determines the circulation speed of the nozzle tube 22 about the workpiece carrier 3, of the shaft 21 of the nozzle device 2, and to maintain the respectively specified value during the specified timeframe. How often the cleaning jet 42 passes over a certain point in this case is dependent on the specified timeframe, which is characterized in the following also as the cleaning time $T_R$, the rotational speed ω31 of the workpiece 5 through the workpiece carrier 3, and the rotational speed ω21 of the shaft 21 of the nozzle device, which is characterized in the following also as circulation speed. An example of this is explained in the following.

Example 1

With reference to this, it should be assumed that the workpiece 5 rotates through the workpiece carrier 3 at a rotational speed ω31=5 rpm (=10π/60 $s^{-1}$) such that the first shaft 21 rotates opposite the second shaft 31 at a rotational speed ω21=−2 rpm (=4π/60 $s^{-1}$) such that n=5 full pivoting movements are completed per revolution of the nozzle tube and that the specified timeframe (the cleaning time $T_R$) is 1 minute. In this case, the workpiece 5 rotates relative to the nozzle tube 22 at a rotational speed of 7 rpm (=14π/60 $s^{-1}$), which corresponds to the difference ω31−−ω21 between the two rotational speeds. Ten full pivoting movements of the nozzle tube 22 are completed per minute (occurring in the two revolutions of the nozzle tube). The same pivot state of the nozzle tube 22 repeats itself every 1/10 min in this example, wherein each time when the same pivot state is repeated, a different point of the surface 51 is impacted by the cleaning jet 42.

Each "pivot state" is determined by a pivot angle of the nozzle tube 22 and a pivoting device. During each complete pivoting movement of the nozzle tube 22, each pivot angle (with the exception of the two angles in the reversal points of the pivoting movement) occur twice: once when the nozzle tube 22 pivots in one direction and once again when the nozzle tube pivots back. Because the pivot directions of the two pivot states in which the nozzle tube 22 has the same pivot angle differ, the workpiece surface is substantially impacted at the same angle in these two pivot states; however, the speeds at which the cleaning jet 42 passes over the workpiece surface 51 differ, as is explained in greater detail below. The fact that each time a pivot state of the nozzle to 22 is repeated a different point of the surface 51 is impacted by the cleaning jet 42 means that each time the cleaning jet 42 impacts a certain point on the surface 51, said point is impacted at a different angle and/or the cleaning jet passes over at a different speed.

Between two repetitions of the pivoting movements, the workpiece 5 in the above example rotates by 14π/10=1.4π relative to the nozzle tube 22 to the extent that two points, which are impacted by the cleaning jet 42 in two sequential pivoting movements during the respectively same pivot state of the nozzle tube 22, are disposed at positions on the surface 51 which are spaced apart from one another by an angle distance 1.4π. In addition, the points in this example do not repeat within the specified timeframe, as is explained in the following.

To this end, it should be assumed that the surface 51 of the workpiece forms a cylindrical coordinate system, in which each point is determined by a particular angle which is between 0 and 2π. In addition, it should be assumed that a characterizes the angle position of a point on the surface, said point being impacted by the cleaning jet 42 during a first pivoting movement of the nozzle tube in a particular pivot state, wherein the points on the surface 51 differ, said points being impacted by the cleaning jet 42 during the first complete pivoting movement of the nozzle tube 22 in different pivot states. In general, the points on the surface 51 are thus impacted by the cleaning jet 42, during a particular pivot state, at angle positions of the workpiece 5, which are specified by $$a+\left(i\cdot\frac{14\pi}{10}\right)\bmod(2\pi)\quad\text{for } 0\le i\le 9, \tag{1}$$

wherein mod(.) characterizes the modulo operation, and α is the angle position of the point at which the particular pivot state first occurs during cleaning. Thus, sequential surface points situated at the following angle positions of the workpiece 5 are impacted by the cleaning jet in the same pivot state: α;

α+1.4π; α+0.8π; α+0.2π; α+1.6π; α+1π; α+0.4π; α+1.8π; α+1.2π; α+0.6π.

During continuation of the cleaning process, these positions would be repeated to the extent that the same point would be impacted repeatedly at the same impact angle. In relation to the workpiece surface, the positions which are impacted at the same impact angle are equidistant and separate from one another by an angle distance of 0.2π, respectively. Of course, smaller angle distances can also be achieved in order to clean the workpiece more consistently by means of a suitable selection of the rotational speeds ω21, ω31, the number n of complete pivoting movements per revolution of the nozzle tube 22, and the cleaning time. With a longer cleaning time, the rotational speeds ω21, ω31 can be adapted to the extent that the angle distance of points lying next to one another on the surface is reduced, said points being impacted at the same impact angle. Two further examples are provided below.

Example 2 n=4; $T_R$=2 min; ω31: 2.5 rpm; ω21: −4 rpm

In this case, 32 complete pivoting movements (4 per revolution with 8 revolutions) occur during the cleaning time. The relative speed of the workpiece 5 relative to the nozzle tube 22 is 6.5 rpm, and positions of the workpiece which are impacted by the cleaning jet in a certain pivot state of the nozzle tube 22 lie at positions which are given by $$a+\left(i\cdot\frac{26\pi}{32}\right)\bmod(2\pi)=a+\left(i\cdot\frac{13\pi}{16}\right)\bmod(2\pi)\quad\text{for } 0\le i\le 31. \tag{2}$$

Example 3 n=4; $T_R$=3; ω31: 2.666 rpm; ω21: −5 rpm

In this case, 60 complete pivoting movements (4 per revolution with 15 revolutions) occur during the cleaning time. The relative speed of the workpiece 5 relative to the nozzle tube 22 is 7.666 rpm, and positions of the workpiece which are impacted by the cleaning jet in a certain pivot state of the nozzle tube 22 lie at positions which are given by $$a+\left(i\cdot\frac{46\pi}{32}\right)\bmod(2\pi)=a+\left(i\cdot\frac{23\pi}{16}\right)\bmod(2\pi)\quad\text{for } 0\le i\le 59. \tag{3}$$

In general, positions of the workpiece which are impacted by the cleaning jet in a particular pivot state of the nozzle tube 22 are given by:

$$a+\left(i\cdot\frac{(\omega 31-\omega 21)\cdot T_R\cdot 2\pi}{n\cdot|\omega 21|\cdot T_R}\right)\bmod(2\pi)\quad\text{for } 0\le i\le(n\cdot|\omega 21|\cdot T_R)-1, \tag{4}$$

wherein the individual parameters, particularly the two angular velocities, are selected such that the values differ by pairs to the extent that the no two values are equal. In this case, an especially efficient cleaning of the workpiece 5 is achieved.

As previously explained, the nozzle 4 has a relative speed v5 relative to the surface 51 of the workpiece 5 due to the circulation speed ω21 (and possibly the rotational movement of the workpiece 5). In one example, it is additionally provided that this relative speed v5 and the pivot speed associated with the pivoting of the at least one nozzle 4 are synchronized with one another to the extent that a speed $v_{REL}$, at which the cleaning jet 42 moves over a specified point at least once, is less than 50%, less than 30%, or less than 10% of the relative speed v5. This is likewise explained by means of FIG. 2.

In the following, v4 characterizes the speed at which the cleaning jet moves relative to the workpiece surface 51 due to the pivoting movement of the nozzle tube 22. The direction in which the cleaning jet moves relative to the workpiece surface 51 and also relative to axis of rotation A-A in this case depends on the current pivot direction of the nozzle tube 22. Merely for explanatory purposes, it should be assumed that the cleaning jet moves relative to the workpiece surface 51 in the first direction when the nozzle tube 22 pivots away from the first endpoint $\mathbf{41}_1$ toward the second endpoint $\mathbf{41}_2$, and the nozzle jet moves relative to the workpiece surface 51 in an opposite second direction when the cleaning jet pivots from the second end position $\mathbf{41}_2$ back to the first end position $\mathbf{41}_1$. If the cleaning jet moves relative to the workpiece surface 51 in the same direction in which the workpiece surface 51 moves relative to the nozzle tube 22, the relative speed $v_{REL}$ of the cleaning jet relative to the workpiece surface 51 is temporarily less than would be the case with a static cleaning jet at the same relative speed v5 of the workpiece surface relative to the nozzle tube. This relative speed $v_{REL}$ is given by the difference v5−v4 between the two speeds v5 and v4.

In the ideal case, the cleaning jet is even temporarily stopped in place over a point on the workpiece surface 51, wherein the impact angle of the cleaning jet changes over time Such a "stoppage" of the cleaning jet over a point on the workpiece surface 51 ensures a particularly intensive cleaning of the respective point on the surface due to the longer time that this point is impacted with the cleaning jet 42 and due to the changing impact angle in this case. Such a point is characterized in the following as an intensive cleaning point or hotspot. The development of such an intensive cleaning point during a cleaning process is explained by means of FIGS. 3A to 3C in the following.

Figure 3A:
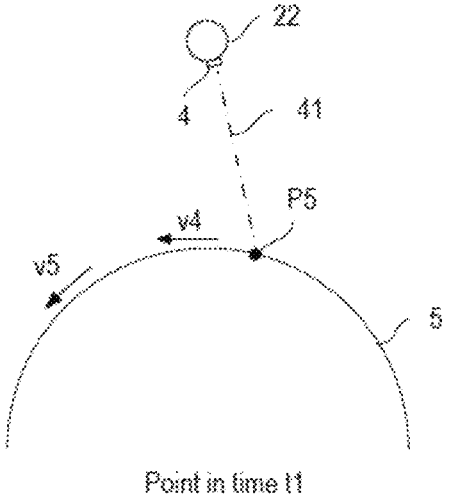
FIGS. 3A-3C illustrate the creation of a point of intensive cleaning (hotspot) on a surface of the workpiece at different points in time during the cleaning process.
Figure 3B:
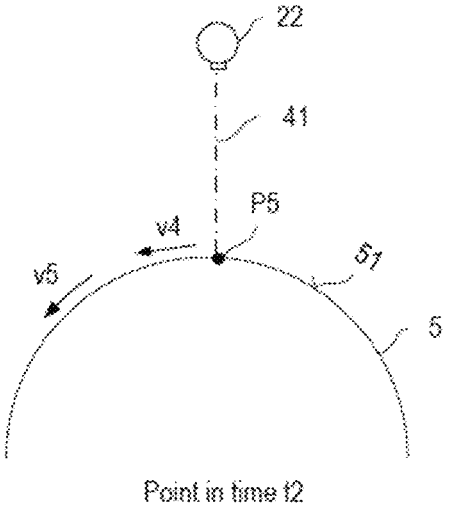
Figure 3C:
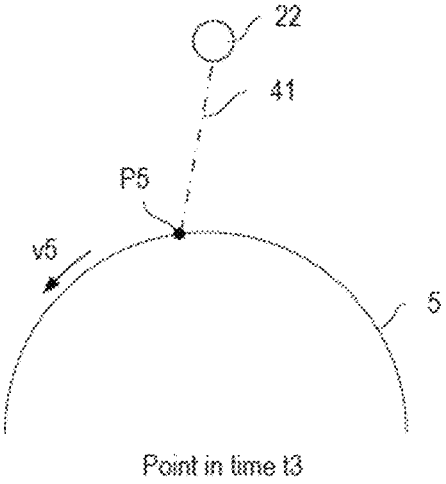

FIGS. 3A-3C schematically illustrate the position of a certain point P5 on the workpiece surface 51 at different points in time t1, t2, t3 during the cleaning process. It should be respectively assumed that the workpiece surface 51, and thus also point P5 on the workpiece surface 51, moves relative to the nozzle tube 22 at speed v5. This point P5 is at a first position at the first point in time shown in FIG. 3A. In addition, it should be assumed that a cleaning jet 41 discharged through the nozzle 4 impacts point P5 on the surface 51 at the first point in time t1, and the nozzle tube 22 pivots from the first end position $\mathbf{41}_1$ (not explicitly indicated in FIGS. 3A-3C) to the second end position $\mathbf{41}_2$ (likewise not explicitly indicated in FIGS. 3A-3C) to the extent that the cleaning jet 41 moves relative to the workpiece surface 51 in the first direction at speed v4. FIG. 3B shows the arrangement at a second point in time t2, at which position P5 has moved further in the first direction due to the relative movement of the workpiece surface 51 relative to the nozzle tube 22, wherein the cleaning jet 41 has also moved further due to the pivoting movement at the workpiece surface 51, and, with the example shown in FIG. 3B, that is just as far as point P5 such that the cleaning jet 41 is quasi-stationary at point p5. FIG. 3C shows the arrangement at a third point in time t3, at which point P5 and, in the same manner, the cleaning jet 41 have moved further in the first direction to the extent that the cleaning jet 41 continues to be quasi-stationary at point P5. Point P5 on the workpiece surface 51 in this case forms a hotspot, as was previously explained. If several nozzles 4 are provided along the longitudinal direction of the nozzle tube 22, the workpiece 5 can be intensively cleaned simultaneously at several points positioned next to one another.

The development of such an intensive cleaning point during the cleaning process depends on various parameters, which are explained by means of FIG. 2 in the following. For this explanation, it should again be assumed that ω31 is the rotational speed of the second shaft 31, which puts the workpiece 5 into rotation, that ω21 is the rotational speed of the first shaft 21 causing the circulation track of the nozzle tube 22, and that d1 is the distance between the workpiece surface 51 and axis of rotation A-A. The relative speed v5 of point P5 on the workpiece surface 51 relative to the nozzle tube 22 is then given by:

$$v5=(\omega 31-\omega 21)\cdot d1 \tag{4}$$

The relative speed v4 of the nozzle jet 41 in relation to the workpiece surface 51 due to the pivoting movement of the nozzle tube 22 is given by the following:

$$v4=\omega 22\cdot d2(\gamma) \tag{5}$$

where ω22=dγ/dt characterizes a pivot speed of the nozzle tube 22, and d2(γ) characterizes a distance between the workpiece surface 51 and axis of rotation B-B of the nozzle tube 22, wherein this distance depends on the respective pivot angle γ.

As previously explained, a hotspot occurs during a timeframe in which the cleaning jet is moving in the first direction at speed v4, which amounts to the relative speed of the workpiece surface v5 relative to the nozzle tube 22, thus at least when v4=v5 approximately applies, i.e. when thus the following relationship applies to the rotational and/or pivot speeds ω21, ω22, ω31:

$$v5 = v4 \rightarrow \frac{\omega 31-\omega 21}{\omega 22} = \frac{d2}{d1} \tag{6}$$

The previous derivation is based on the idealized assumption that the workpiece 5 is cylindrical to the extent that a distance between the workpiece surface 51 and axis of rotation A-A is thus the same universally. This is typically not the case. However, the rotational speeds ω31, ω21 based on this derivation are adjusted such that an efficient cleaning method is achieved. Thus, for determining distance d1 from the workpiece surface 51 to axis of rotation A-A and/or distance d2 from the pivoting axis B-B to the workpiece surface 51, an averaged workpiece surface is assumed 51 which represents an average distance of all points between the workpiece surface to be cleaned and axis of rotation A-A.

As explained above, the nozzle assembly 2 may be implemented such that the pivoting movement of the nozzle tube 22 is tightly coupled with the circulating movement of the nozzle tube 22 about the workpiece 5 to the extent that a particular angle position of the nozzle tube 22 is assigned to each position of the nozzle tube 22 on the circulation track, i.e. each angle position of the first shaft 21 relative to a starting point. According to one example, it is provided in this case that an integer number n of complete pivoting movements of the nozzle tube 22 are executed with each revolution of the nozzle tube 22 about the workpiece 5, i.e. with each complete rotation of the first shaft 21. In this case, n hotspots can be created per revolution of the nozzle tube 22, because the nozzle jet moves n-times in the same direction as the workpiece surface 51 relative to the nozzle tube 22 due to the pivoting movement of the nozzle tube 22. Moreover, the pivot speed of the nozzle tube 22 in this case depends directly on the rotational speed ω21 of the first shaft 21. Time $T_S$ of a complete pivoting movement of the nozzle tube 22 is then given by:

$$T_S = \frac{2\pi}{\omega 21}\cdot\frac{1}{n}, \tag{7}$$

wherein the duration of a revolution of the nozzle tube 22 about the workpiece 5 is given by 2π/ω21. Time $T_{HS}$, while the cleaning jet is moving in the same direction as the workpiece surface 5 relative to the nozzle tube 22 during a pivot time $T_S$, is half of pivot time $T_S$, thus $$T_{HS} = \frac{\pi}{\omega 21}\cdot\frac{1}{n}. \tag{8}$$

$T_{HS}$ determines the time during which the workpiece surface 51 and the cleaning jet are moving in the same direction, and thus the maximum time during which (theoretically) a hotspot can occur. When the pivot speed ω22 is constant, for example, the pivot speed ω22 is given by:

$$\omega 22 = \frac{\Delta\gamma}{T_{HS}} = \frac{\Delta\gamma}{\pi}\cdot\omega 21\cdot n. \tag{9}$$

Thus, the pivot speed is dependent on the circulation speed ω21 of the nozzle tube and the number n of hotspots to be created and increases as the circulation speed ω21 increases and as the number n of the hotspots increases.

As shown in FIG. 2, distance d2(γ) between the nozzle and the workpiece surface 51 changes as a function of the angle position γ of the nozzle tube 22 such that, according to the equation (5), the relative speed v4 of the nozzle jet relative to the workpiece surface 51 not only is dependent on the pivot speed ω22, but also on the varying distance d2(γ), wherein, at a constant pivot speed ω22, the relative speed v4 increases as the distance increases and thus as the deflection of the nozzle 4 increases relative to the zero position $\mathbf{41}_0$.

According to one example, it is provided that the pivot speed ω22 is approximately constant. In an angle range of +/−15° about the zero position $\mathbf{41}_0$, distance d2(γ) and thus the relative speed v4 are approximately constant to the extent that the rotational speeds ω21, ω31 of the two shafts can be determined with consideration of equations (6) and (9), wherein d2 in this case is the distance between the workpiece surface 51 and pivoting axis B-B in the zero position $\mathbf{41}_0$.

In order to increase the angle range in which a hotspot occurs about the zero position, it is provided in one example to vary the pivot speed such that it decreases as the deflection of the nozzle relative to the zero position $\mathbf{41}_0$ decreases in order to compensate for the increasing deflection as the distance becomes greater. Thus, the pivoting movement could occur, for example, such that the nozzle tube pivots at a first pivot speed in a first pivot range $\gamma 0+\Delta\gamma 1 \leq \gamma \leq \gamma 0-\Delta\gamma 1$, which is positioned at an angle γ0 of the zero position and pivots at a first pivot speed, and, in a second and third pivot range $\gamma > \gamma 0+\Delta\gamma 1$ and $\gamma < \gamma 0-\Delta\gamma 1$, which are outside of the first pivot range, at a second pivot speed which is lower relative to the first pivot speed.

Figure 4A:
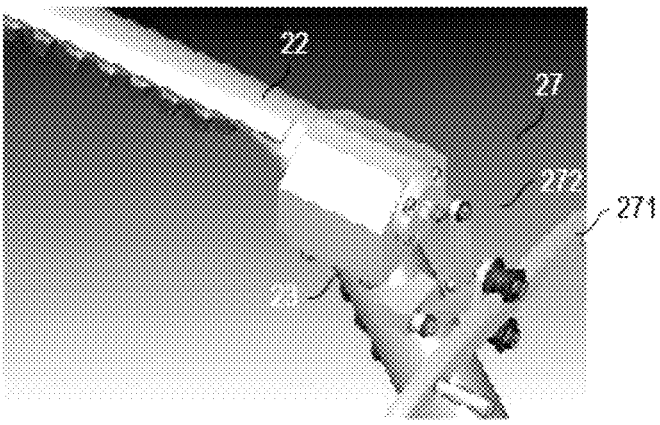
FIGS. 4A-4D schematically show an example of a pivoting device for pivoting a nozzle tube of the nozzle device.
Figure 4B:
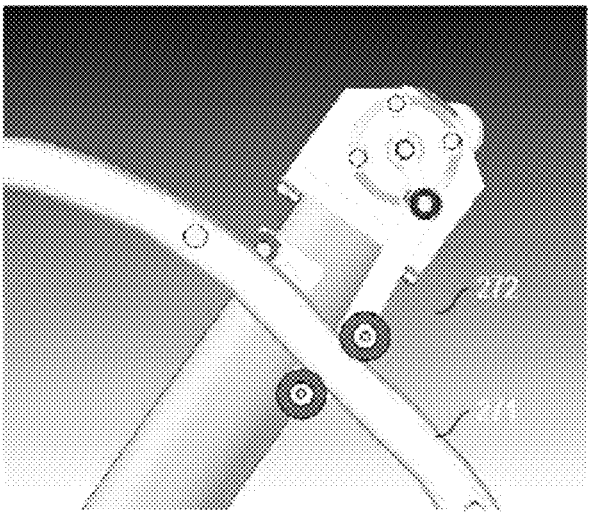
Figure 4C:
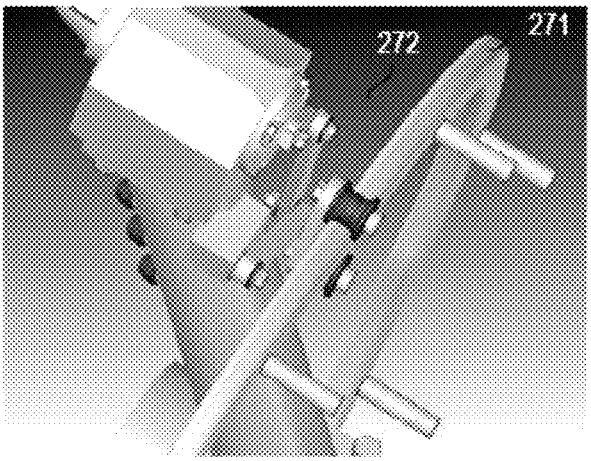
Figure 4D:
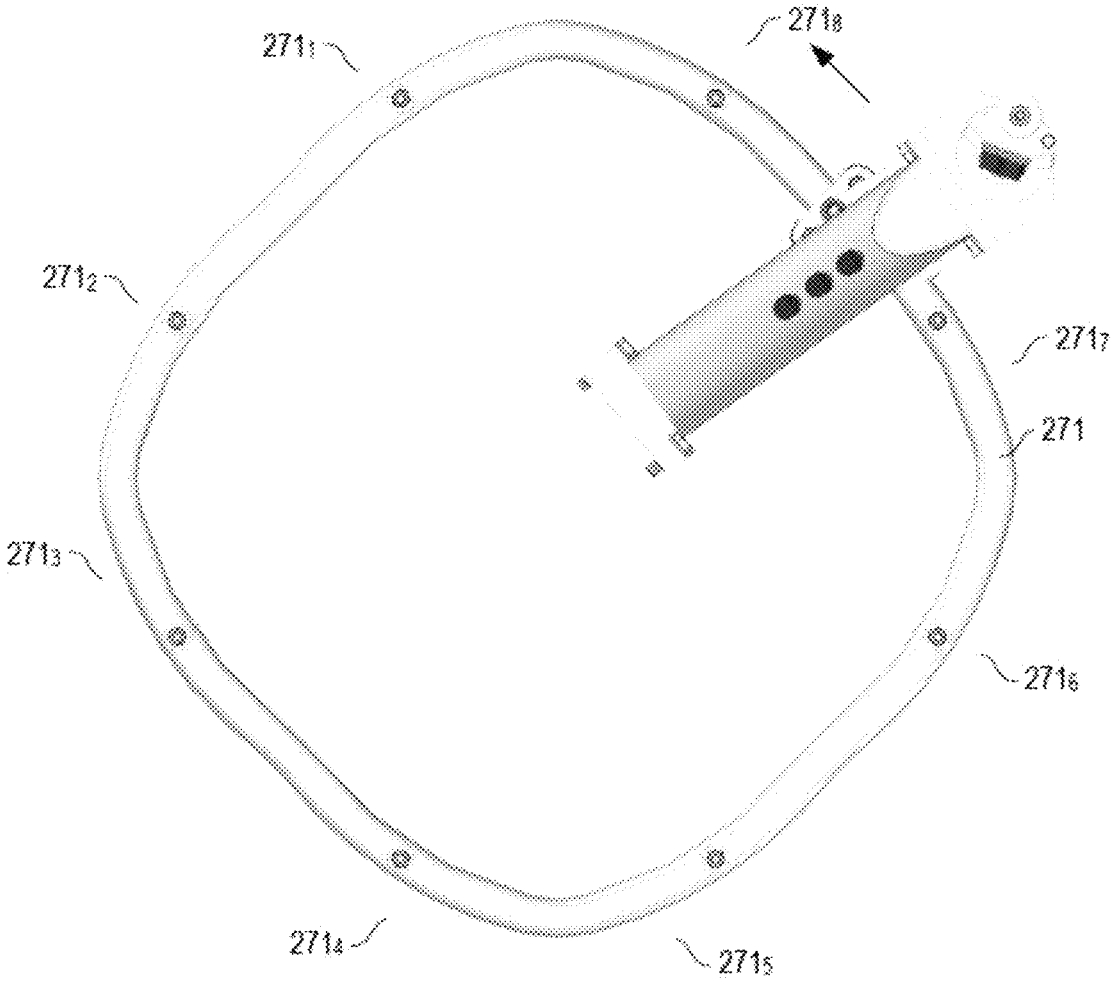

A pivoting movement of the nozzle tube 22 coupled to the circulating movement of the nozzle tube 22 can be achieved in the most varied of ways. An example of this is shown in FIGS. 4A-4D. FIGS. 4A-4C each show a section of the pivotable nozzle tube 22, of the supply tube 23, and of a pivoting device 27 coupled to the nozzle tube 22, and FIG. 4D shows a top view of a curved track 271 of the pivoting device 27.

With reference to FIGS. 4A-4C, the pivoting device 27 comprises a lever assembly 272, which is mechanically coupled to the nozzle tube 22 and then again to the curved track. The coupling of the lever assembly 272 to the curved track takes place in the example by means of rollers; however, it could take place also by means of one or more gear wheels or in another suitable manner. The unique assignment of the position on the circulation track to a pivot position of the nozzle tube is implemented with said pivoting device by means of a radial distance between the curved track 271 and the circulation track of the nozzle tube 22, said radial distance being in relation to axis of rotation A-A. The circulation track of the nozzle tube is substantially circular and has a radius which is substantially determined by the length of the supply tube 23 and the radius of the first shaft 21. The curved track 271 is noncircular to the extent that a radial distance between the curved track 271 and the nozzle tube 22, or the circulation track thereof, while a revolution of the nozzle tube 22 about the workpiece 3 varies. The lever assembly 272 implements this varying distance in the form of a pivoting movement of the nozzle tube 22 such that the nozzle tube 22 pivots in one direction when the nozzle tube 22 is in a section of its circulation track in which the distance to the curved track 271 increases, and pivots in an opposite direction when the nozzle tube 22 is situated in a section of its circulation track in which the distance to the curved track 271 decreases.

With the curved track shown in FIG. 4D, there are four such curved track sections $\mathbf{271}_1$, $\mathbf{271}_3$, $\mathbf{271}_5$, $\mathbf{271}_7$, in which the distance between the curved track 271 and the nozzle tube is increasingly reduced when the nozzle tube 22 is moving in the circulation track indicated by the arrow. These curved track sections $\mathbf{271}_1$, $\mathbf{271}_3$, $\mathbf{271}_5$, $\mathbf{271}_7$ are characterized in the following as the first curved track sections. In addition, there are four second curved track sections $\mathbf{271}_2$, $\mathbf{271}_4$, $\mathbf{271}_6$, $\mathbf{271}_8$, in which the distance between the curved track 271 and the nozzle tube is increasingly increased when the nozzle tube 22 is moving in the circulation track indicated by the arrow. There is a turning point, at which the curved track has locally a minimum or a maximum distance, said turning point being situated between adjacent first and second curved track sections, wherein the nozzle tube 22 changes its pivot direction when the nozzle tube 22 passes a respective turning point. Thus, four complete pivoting movements are executed per revolution by means of the curved track shown in FIG. 4D. The number of pivoting movements can obviously be adjusted in almost any manner through a suitable selection of the number of the first and second curved track sections.

According to one example, it is provided to implement the first and second curved track sections respectively symmetrically as relates to the turning points and to arrange the cam disc such that corresponding turning points are situated equidistant from the circulation track. In this case, the individual pivoting movements at a given circulation speed always occur in the same manner, i.e. within the angle range thereof and with the same progression of pivot speed within a pivoting process, wherein said pivot speed may vary within a pivoting process.

The pivoting device shown in FIGS. 4A-4C is only one of many possible examples, by means of which a coupling can be achieved between the pivoting movement of the nozzle tube 22 and the circulating movement of the nozzle tube 22. According to a further example, it is provided to record an angle position of the first shaft 21 by means of an encoder and to pivot the nozzle tube 22 as a function of the recorded angle position by means of a motorized or hydraulically driven actuator. Such an actuator could execute a pivoting movement of the nozzle tube as a function of an angle position of the first shaft 21 via a lever assembly of the type shown in FIGS. 4A-4C.

Figure 5:
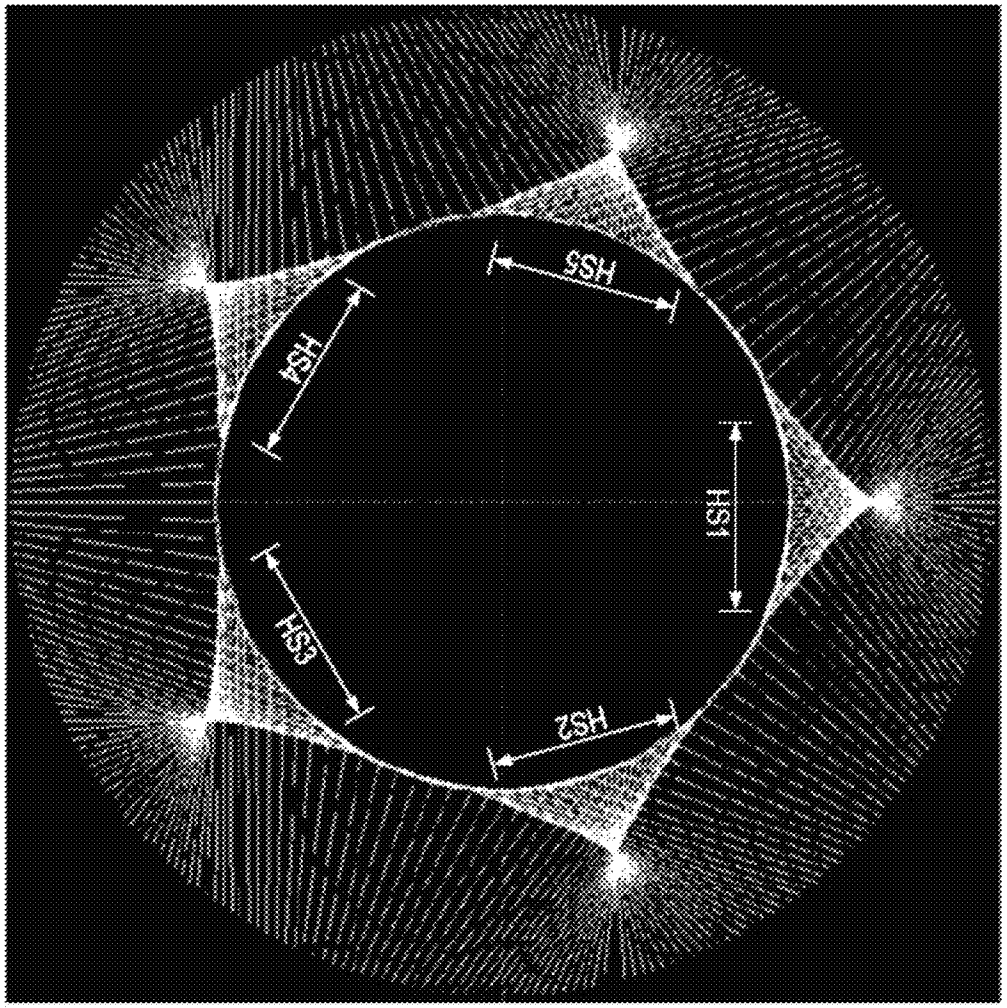
FIG. 5 illustrates cleaning jets in the context with five different hotspots.

FIG. 5 illustrates cleaning jets which are discharged during a circulation track of the nozzle tube 22 about the workpiece carrier 3 or the workpiece 5, wherein the nozzle tube in this example pivots five times completely during one revolution. Accordingly, there are five hotspot areas HS1-HS5, i.e. five areas of a circulation track of the nozzle tube 22 in which a hotspot can occur when the rotational speeds ω21, ω31 of the first and second shaft 21, 31 are suitably adapted to one another, for example according to equations (3) and (6).

According to one example, it is provided to select target values for rotational speeds ω21, ω31 and to keep the rotational speeds constant at the respective target value for the duration of the rotation process based on the desired cleaning time, the permissible ranges for the rotational speeds ω21, ω31, and the number n of pivoting movements occurring per revolution of the nozzle tube. To this end, control of the two motors 6, 7 may be provided in that, for example, the rotational speeds of the two shafts 21, 31 are recorded by means of encoders, said rotational speeds are compared to the target values, and the motors 6, 7 are actuated as a function of the comparison results. Without control of the motors 6, 7, the circulation speed of the nozzle tube, for example, could then always temporarily accelerate due to the gravitational force when the nozzle tube 22 moves from a highest point on the circulation track (above as with the example according to FIG. 1B) to a lowest point on the circulation track (below as with the example according to FIG. 1B) and then always temporarily decelerate when the nozzle tube 22 moves from the lowest point on the circulation track (above as with the example according to FIG. 1B) to the highest point on the circulation track.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A cleaning device, comprising:

a treatment container;

a workpiece carrier arranged in the treatment container and configured to hold at least one workpiece;

at least one nozzle configured to discharge a cleaning jet directed onto the workpiece carrier and mounted such that the at least one nozzle is moveable on a circulation track about the workpiece carrier and is pivotable about a picoting axis extending parallel to an axis of rotation of the workpiece carrier;

a pivoting device configured to pivot the at least one nozzle; and a controller configured to control a circulating movement of the at least one nozzle on the circulation track and a pivoting movement of the at least one nozzle, such that a specified point on a surface of the at least one workpiece is impacted repeatedly by the cleaning jet at a respectively different angle, within a specified timeframe, wherein the at least one nozzle is arranged on a nozzle tube, wherein the pivoting device comprises a noncircular curved track and a lever assembly coupled between the noncircular curved track and the nozzle tube, wherein the lever assembly is configured to adjust a pivot angle of the nozzle tube as a function of a current radial distance between the nozzle tube and the noncircular curved track.

2. The cleaning device of claim 1, wherein the workpiece carrier is rotatably mounted.

3. The cleaning device of claim 1, wherein the pivoting device is configured such that an angle position of the at least one nozzle is uniquely assigned to each position of the at least one nozzle on the circulation track during the pivoting movement.

4. The cleaning device of claim 3, further comprising:

a first motor configured to execute the circulating movement of the at least one nozzle; and a second motor configured to execute rotational movement of the workpiece carrier, wherein the controller is configured to control the circulating movement of the at least one nozzle on the circulation track and the pivoting movement of the at least one nozzle, by controlling the first motor and the second motor.

5. The cleaning device of claim 1, wherein the controller is configured to synchronize a relative speed of the at least one nozzle relative to the specified point on the surface of the at least one workpiece due to a circulation speed with a pivot speed associated with pivoting of the at least one nozzle, such that a speed at which the cleaning jet moves over a specified point at least once is less than 50% of the relative speed.

6. The cleaning device of claim 1, wherein the controller is configured to vary a nozzle pivot speed associated with the pivoting of the at least one nozzle, such that the pivot speed decelerates as deflection increases relative to a zero position in which the cleaning jet is directed onto the axis of rotation of the workpiece carrier.

7. The cleaning device of claim 1, wherein the controller is configured to pivot the at least one nozzle n-times from a first endpoint to a second endpoint and back to the first endpoint per revolution of the at least one nozzle about the workpiece carrier, where $n>1$.

8. The cleaning device of claim 1, wherein the controller is configured to pivot the at least one nozzle within an angle range between 30° and 70°.

9. The cleaning device of claim 1, wherein the controller is configured to circulate the at least one nozzle on the circulation track in a rotation direction opposite a rotation direction of the workpiece carrier.

* * * * *